US005577817A

United States Patent [19]

Reynolds

[11] Patent Number: 5,577,817

[45] Date of Patent: Nov. 26, 1996

[54] PORTABLE PAINTS AND SUPPLIES STORAGE AND WORK ENCLOSURE

[76] Inventor: Cory Reynolds, 120 Rodeo Ave., Apt. 1, Rodeo, Calif. 94572

[21] Appl. No.: 509,240

[22] Filed: Jul. 31, 1995

[51] Int. Cl.[6] ..... A47B 77/02

[52] U.S. Cl. ..... 312/107; 312/1; 312/213; 312/209; 312/249.8; 126/299 R; 126/299 D

[58] Field of Search ..... 126/299 R, 299 D; 312/1, 213, 209, 249.8, 107

[56] References Cited

U.S. PATENT DOCUMENTS

| | | | |
|---|---|---|---|
| 1,778,163 | 10/1930 | Moore | 312/213 |
| 2,000,981 | 5/1935 | Parsons | 312/141 |
| 3,008,785 | 11/1961 | Gehrs | 312/209 |
| 3,455,620 | 7/1969 | Coburn | 312/209 |
| 3,524,256 | 8/1970 | Barker | 312/209 |
| 3,969,006 | 7/1976 | Brown | 312/234.1 |
| 4,669,790 | 6/1987 | Briggs | 312/208 |
| 4,938,548 | 7/1990 | Richardson | 312/233 |
| 5,232,152 | 8/1993 | Tsang | 236/44 A |

*Primary Examiner*—Peter M. Cuomo
*Assistant Examiner*—Stephen Vu
*Attorney, Agent, or Firm*—James M. Ritchey

[57] ABSTRACT

A portable enclosure utilized for storing and working with paints and paint related items comprises a lower housing having a bottom surface and a spill containing upper working surface. Included is an upper housing positioned above the lower housing. Casters are associated with the lower housing bottom surface and permit movement of the storage enclosure over a supporting surface. An exhaust fan is provided to vent harmful vapors away from the working surface and the housings.

6 Claims, 4 Drawing Sheets

PORTABLE PAINTS AND SUPPLIES STORAGE AND WORK ENCLOSURE

BACKGROUND OF THE INVENTION

1. Field of the Invention

Described here is a means for storing items utilized in painting automotive vehicles. More particularly, the subject invention comprises a portable paint and supplies storage cabinet that includes optional venting capabilities via a detachable hood.

2. Description of the Background Art

Fume hoods for working with chemicals having harmful vapors have been used for many years. Most of these devices comprise a centralized compartment and an exhaust means affixed to that compartment. Chemical laboratories have traditionally had large, fixed position hoods that vent to a distant location.

Disclosed in U.S. Pat. No. 3,011,425 is a fume hood with a vented storage compartment. A stationary fume containing apparatus contains a series of storage compartments behind the general working area.

U.S. Pat. No. 3,415,180 relates a multiple compartment fume cabinet that includes an evacuation chamber. Above a working compartment are two upper chambers that serve as evacuation and blowing conduit holding chambers.

Presented in U.S. Pat. No. 4,023,473 is a fume hood that splits the intake air into two flows with one of the flows blowing into the working area via sliding front panels and the other flow passing partially directly into the working area and partially into the upper air exhaust opening. The flow entering via the front panels and the flow passing directly into the working area combine and exit via a lower rear vent opening into a flue that mixes with the flow vented into the upper air exhaust opening.

A ventilation system for artists is revealed in U.S. Pat. No. 4,840,169. Comprising the ventilation system, which is portable, is a blower, a hollow box, a palette, a lid, and a respiration unit. The device is utilized by painters when mixing paints and solvent or during painting. Spacers position the palette for suitable circulation of the venting air flow.

U.S. Pat. No. 4,856,420 exhibits a fixed position fume hood that is typical of standard chemical storage and working hoods. Incoming air either passes into the working area via an upper opening or a lower opening under a front sash and below the limit of the closed front panel. A base pedestal provides support for the hood chamber. To minimize the reflection of light, the front panel is comprised of an angled transparent material.

In U.S. Pat. No. 5,312,297, means are provided for controlling air flow in equipment found in chemical laboratories. Several generalized air flow systems are described in the '297 patent.

A hazardous materials handling apparatus is detailed in U.S. Pat. No. 5,360,371. Included are first and second working zones with a transfer opening between them. Further, first and second access openings are provided. Additionally, means are involved for providing a liquid barrier around the second work zone.

The prior art fails to provide a portable storage apparatus that is directed to a painter's needs which includes optional venting capabilities and is easily moved from one location to another.

The foregoing information reflects the state of the of which the applicant is aware and is tendered with the view toward discharging applicant's acknowledged duty of candor in disclosing information which may be pertinent in the examination of this application. It is respectfully submitted, however, that this information does not teach or render obvious, singly or when considered in combination, applicant's claimed invention.

SUMMARY OF THE INVENTION

An object of the present invention is to provide an enclosure that is adapted to facilitate easy storage of painting equipment, paints, solvent, and the like.

Another object of the present invention is to disclose a portable storage enclosure that functions to house painting items.

A further object of the present invention is to describe a vented and movable storage cabinet for accommodating painting items.

Still another object of the present invention is to furnish a portable storage cabinet that includes a spill-containment working surface, a plurality of storage compartments, and a venting hood.

Disclosed is a portable storage enclosure generally utilized by a user or painter for storing paints and paint related materials such as spray equipment, solvents, brushes, and the like. Lower and upper housings are provided. The lower housing has a bottom surface and an upper working surface. Additionally, the lower housing comprises a plurality of first compartments between the bottom surface and the upper working surface. Included are means for accessing each of the plurality of first compartments. For convenience and safety, means are associated with the upper working surface for containing spills or paints, solvents, and the like. The upper housing is positioned above the lower housing and comprises a plurality of second compartments and means for accessing each of the plurality of second compartments. Means are associated with the upper housing for exhausting vapors to behind the subject apparatus or to a location distant to the subject device. For easy movement, a plurality of casters are affixed to the lower housing bottom surface.

Other objects, advantages, and novel features of the present invention will become apparent from the detailed description that follows, when considered in conjunction with the associated drawings.

DESCRIPTION OF THE PREFERRED EMBODIMENT

Figure 1:
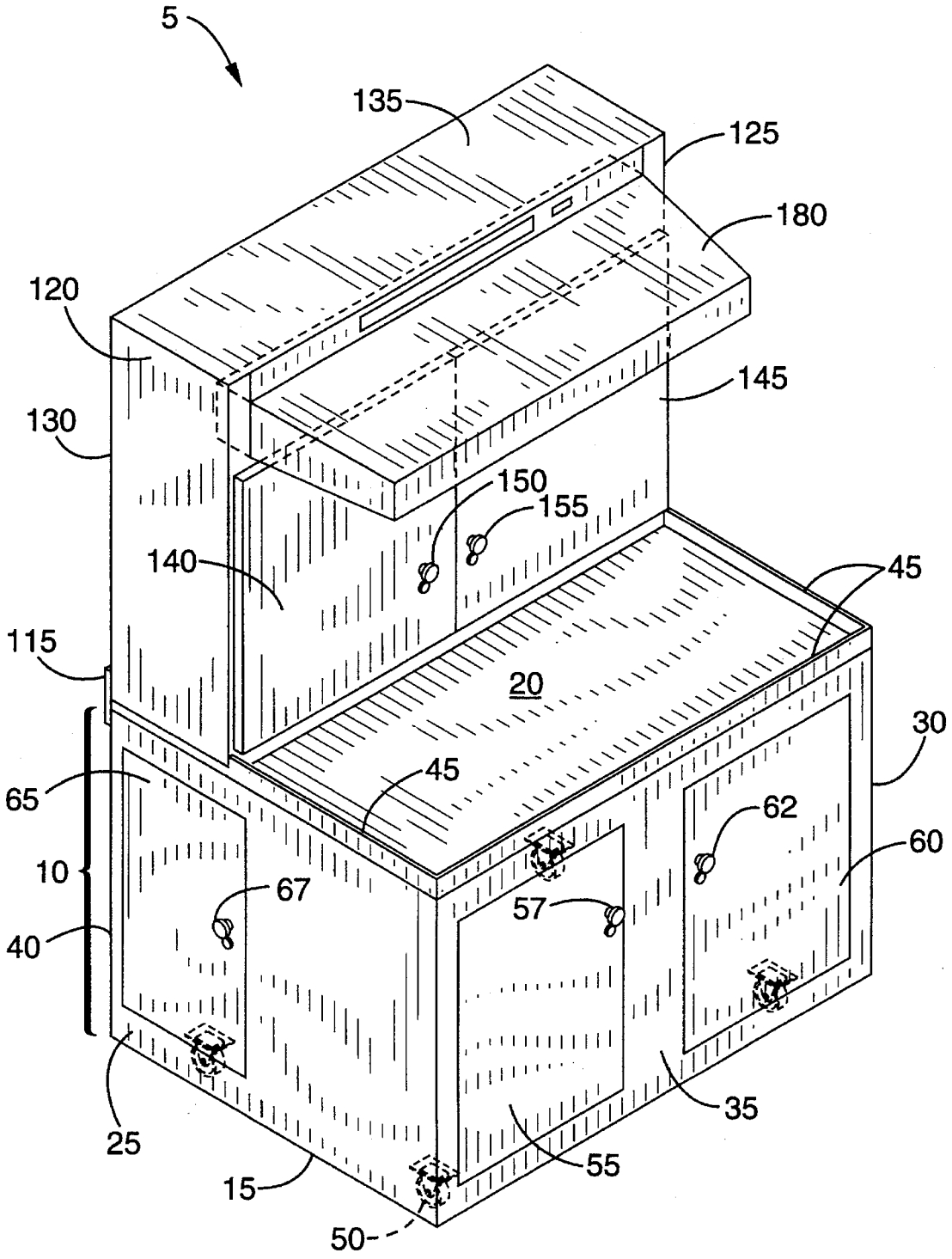
FIG. 1 is a perspective view of the subject invention.

Referring now to FIGS. 1–5, there is shown an apparatus that is used for storing paint and paint related items that is of particular use by a painter involved in automotive, aviation, marine, and similar painting procedures where it is important to have most, if not all, of the necessary paints and equipment is a compact mobile unit for movement to and from varied painting projects. For example, an automotive painter wheels the subject storing and working cabinet to the vicinity of a car, truck, or equivalent that is to be painted and the required paint mixing, spray equipment assembly, cleanup, and the like are accomplished at that location.

Since the vapors emitted from paints and solvents are usually harmful to the painter, the subject invention is fitted with a venting or exhaust system that removes vapors from a working and transfers those vapors either to the rear of the subject device where they can safely dissipate or to a distant location via appropriate ducting.

More specifically, the subject invention comprises a lower housing 10. Usually, the lower housing is a generally rectangular box with a bottom surface 15, an upper working surface 20, opposing side panels 25 and 30, a front panel 35, and a back panel 25. The lower housing 10, as well as the remainder of the subject device, is preferably fabricated from sturdy material able to hold up to long term use. Wood or wood products, metals, natural and synthetic polymers, and the like are acceptable when utilized in an appropriate manner. For example, the subject apparatus can be fabricated from a combination of wood and stainless steel or other suitable materials.

Generally, the upper working surface 20 covers the entire top of the lower housing 10 and is constructed from rugged and usually paint and solvent inert or resistant materials such as stainless steel, polymers, and the like. Preferably, the upper working surface 20 covers the majority of the top of the lower housing 10. For neatness and safety reasons, means are provided to prevent spills of liquids, or possibly solids or powders, from off the upper working surface 20. Although equivalent spill prevention means are contemplated, preferably, an anti-spill lip 45 is fitted to or formed in or at the perimeter of the upper working surface 20. The anti-spill lip 45 is usually a continuous and elevated barrier that prevents spills from leaving the upper working surface or area 20. However, the anti-spill lip 45 may have means such as a gap or aperture in its length for permitting a user to drain any spill into an appropriate container for disposal or recycling.

To permit the user of the subject device to move the apparatus from location to another location over a supporting surface such as a floor, movement or transportation means are associated with the lower housing 10. Specifically, attached by suitable means to the lower housing bottom surface 15 are casters or wheels 50. Usually, one caster 50 is affixed proximate each bottom surface 15 corner. FIGS. 1–4 indicate four casters 50 are secured to the bottom surface 15, however, other quantities of casters 50 and locations for casters 50 is considered to be within the realm of this disclosure. Movement locking means (not shown) may be associated with the casters 50.

Associated with the lower housing 10 is a plurality of storage or first compartments that are formed and positioned between the bottom surface 15 and the upper working surface 20. Means are provided for accessing each of the first compartments. Usually, doors 55, 60, 65, and 70 are the accessing means, as illustrated in FIGS. 1–4. Each door 55, 60, 65, and 70 is fitted with a handle or handle and lock combination 57, 62, 67, and 72, respectively, and is hinged by traditional means to a suitable location. The interior volume of the various first compartments can be varied to suit the needs of the user. Often a compartment is adapted to contain sliding drawers such as drawers 75, 80, and 85 or fitted with a shelf 90 to divide out separate spaces 95 and 100. Clearly, access to the internal compartments is by doors 55 and 60 that enter via the front panel 35 or by doors 65 and 70 that enter through the side panels 25 and 30, respectively.

Figure 2:
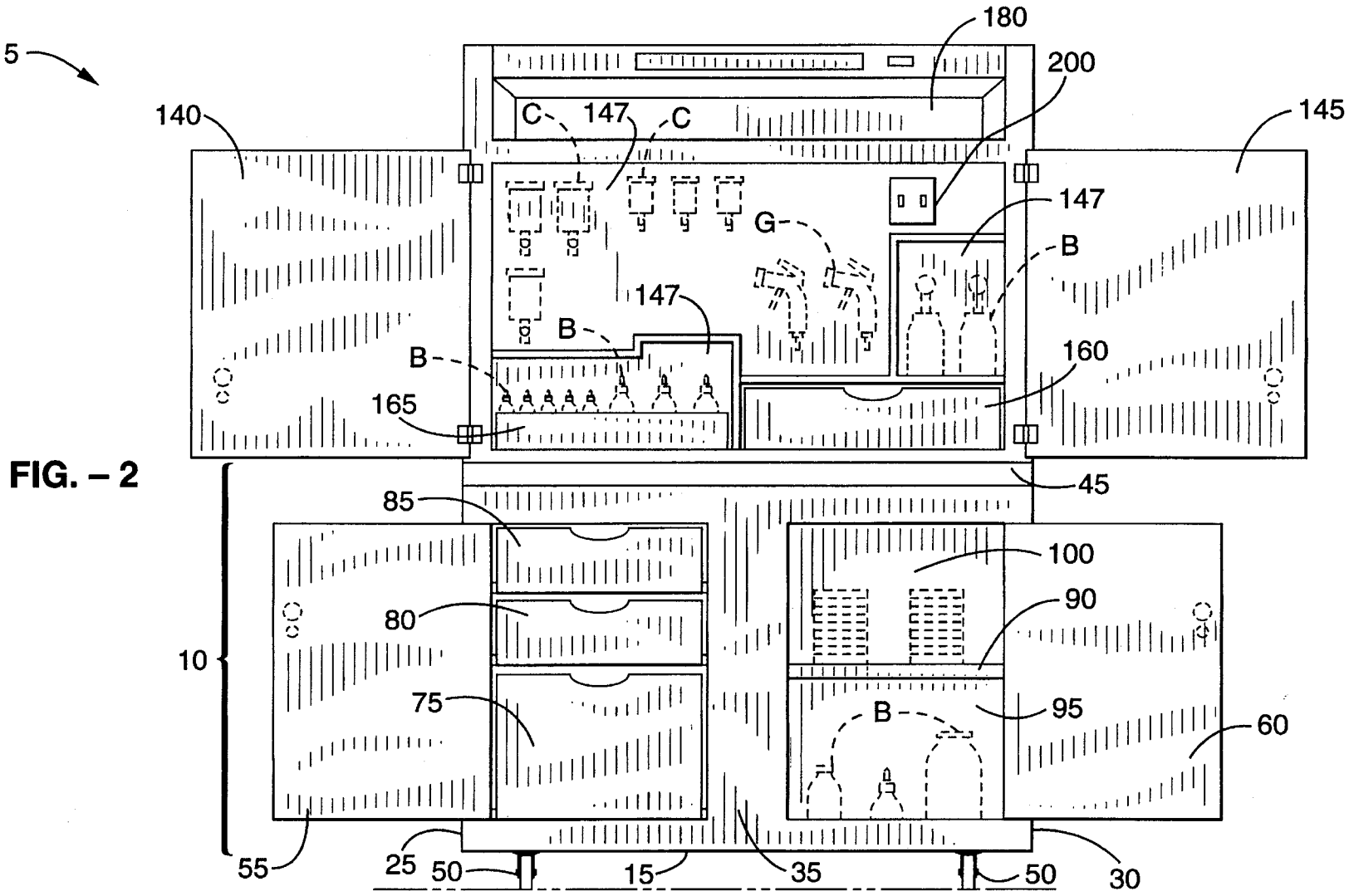
FIG. 2 is a front view of the-subject invention showing the cabinet doors in an open position.
Figure 3:
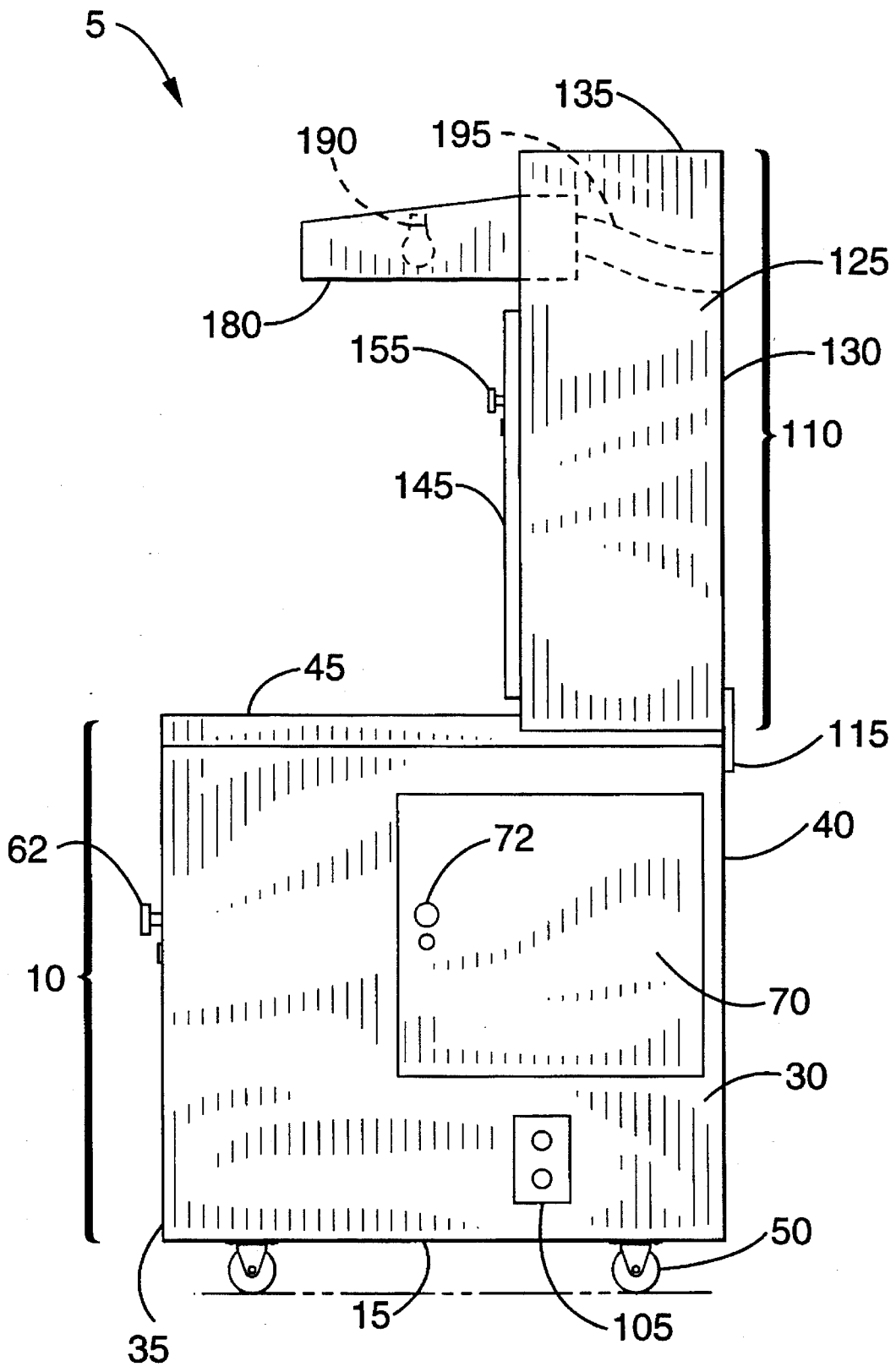
FIG. 3 is a first side view of the subject invention.

For devices (lights, fans, electrical equipment) that require electricity, an electrical box and external power plate 105 is provided on one or more of the panels for holding the wires and fittings required to make an electrical connection with a suitable power source. FIG. 3 shows that such an external electrical plate 105 is associated with the side panel 30, but the other panels 25, 35, or 40 are acceptable. Standard means are contemplated for connecting electrical power to the subject device's plate 105. Although not shown in FIGS. 1–5, sources for water, vacuum, positive pressure, and the like are considered within this disclosure.

Figure 4:
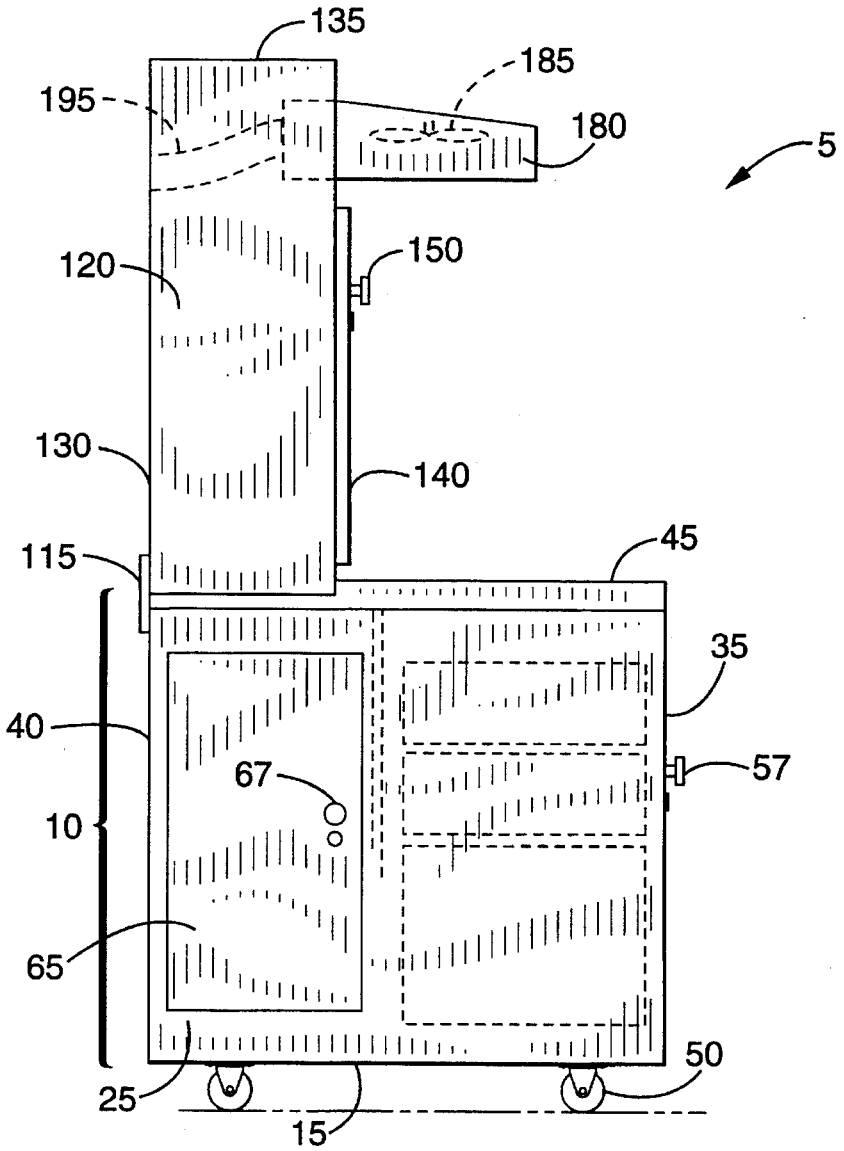
FIG. 4 is a second side view of the subject invention.
Figure 5:
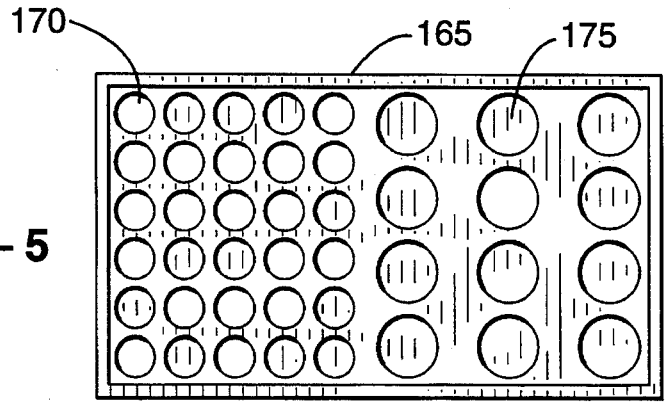
FIG. 5 is a plan view of the interior of a drawer found in the subject invention.

Located above the lower housing 10 is an upper housing 110. Usually, for stability, the upper housing is 110 fastened by appropriate means to the lower housing 10. FIGS. 1, 3, and 4 depict the fastening means as one or more brackets 115 anchored to and between the upper 110 and lower 10 housings. The anchoring means between the two housings 10 and 110 may be permanent to prevent simple separation or releasable to permit the user easy separation of the two pieces 10 and 110.

Comprising the upper housing 110 are opposing side panels 120 and 125, a back panel 130, and a top panel 135. Usually, a lower or bottom panel (not shown) opposes the top panel 135 to form a five sided enclosed structure with a front facing area. The front facing area is utilized to hold means for accessing an interior compartment or compartments within the upper housing 110 and to mount a means for exhausting vapors.

Specifically, within the upper housing 110 is one or a plurality of second or interior compartments that are accessed via one or a plurality of doors 140 and 145. Each door 140 and 145 is usually fitted with a handle or handle and lock combination 150 and 155, respectively. Each door 140 and 145 is hinged with standard means to or proximate to the appropriate side wall 120 and 125, respectively.

Behind the upper doors 140 and 145 is an interior or second compartment that is usually divided by walls and shelves into several smaller volumes or spaces 147. FIG. 2 illustrates a typical configuration for the interior upper compartment. Drawers such as the drawer 160 are mounted within the upper housing 110 to store needed items. Various items are stored in various locations within the upper 110 and lower 10 housings. For example, the items stored within any interior space may be paint spray containers C, paint spray guns or handles G, bottles B, and the like. Specifically, smaller bottles B of the dropper type, that hold color tints and the like, are often stored is a tray 165 that has a series of first 170 and second 175 sized depressions (see FIG. 5 for details). A tray similar to tray 165 can be located in other locations within the subject device such as in any of the drawers 75, 80, 85, and 160 or other interior spaces.

When paints and solvent are utilized by the user, harmful or toxic vapors may accumulate. To remove or vent the fumes or vapors to a different location, exhaust means are provided. Preferably, the exhaust means is a hood fitted with means for drawing in and exhausting the vapors. Specifically, a hood 180, fan 185, and light 190 combination is utilized. Coupling the exhaust hood 180 and fan 185 combination to a venting location is ducting 195. Often the venting location is merely the rear of the upper housing 110, however, the ducting 195 may be adapted with additional ducting to vent the vapors to a distant locale away from the subject apparatus. Additionally, the hood unit (hood 180, fan 185, and light 190) may be associated with the upper housing 110 in a stationary arrangement (seen in the figures) or adapted to move into or retract into the upper portion of the upper housing 110 when not in use or not needed.

To activate the exhaust fan 185 and light 190 and to provide an optional electrical outlet, an electrical box, plate, switches, outlet plugs, and the like are provided, usually within the upper housing 110 in a convenient position 200.

By way of brief summary of use, when employing the subject invention a painter might move the device near an vehicle to be painted and the needed electrical connections made. If the exhaust unit is to be vented to a distant location, the required additional ducting is connected. The upper housing is opened and, if desired, the fan and light activated. As utilized in the painting process, the required items are removed from and eventually replaced into the upper 110 or lower 10 housing. Likewise, paints and solvents are removed and replace as needed. Should spills be created, the spill containment area is drained and usually cleaned. Other equivalent methods for practicing the subject invention are considered within the sphere of this disclosure.

Further, the invention has now been explained with reference to specific embodiments. Other embodiments will be suggested to those of ordinary skill in the appropriate art upon review of the present specification. Although the foregoing invention has been described in some detail by way of illustration and example for purposes of clarity of understanding, it will be obvious that certain changes and modifications may be practiced within the scope of the appended claims.

What is claimed is:

1. A portable paint and paint related items storage enclosure utilized by a painter, comprising:

a) a lower housing having a bottom surface, an upper working surface, two opposing side panels, a front panel, and a back panel, wherein said lower housing contains a plurality of first compartments between said bottom surface and said upper working surface and means associated with said front panel and each of said two opposing side panels for accessing each of said plurality of first compartments;

b) a continuous perimeter lip raised above and surrounding said working surface for containing liquid spills;

c) an upper housing having two opposing side panels, a back panel, a top panel, and a front facing area holding at least one access door positioned above said lower housing, wherein said upper housing contains a plurality of second compartments; and d) means associated with said lower housing for permitting movement by the user of the storage enclosure over a supporting surface.

2. A portable storage enclosure according to claim 1, further comprising means associated with said upper housing for exhausting vapors when said access door is either closed or open.

3. A portable paint and paint related items storage enclosure utilized by a painter, comprising:

a) a lower housing having a bottom surface, an upper working surface, two opposing side panels, a front panel, and a back panel, wherein said lower housing contains a plurality of first compartments between said bottom surface and said upper working surface and means associated with said front panel and each of said two opposing side panels for accessing said plurality of first compartments;

b) a continuous perimeter lip raised above and surrounding said working surface for containing liquid spills;

c) an upper housing having two opposing side panels, a back panel, a top panel, and a front facing area holding at least one access door positioned above said lower housing, wherein said upper housing contains a plurality of second compartments;

d) means associated with said lower housing for permitting movement by the user of the storage enclosure over a supporting surface; and e) means for associated with said upper housing for exhausting vapors when said access door is either closed or open.

4. A portable paint and paint related items storage enclosure utilized by a painter, comprising:

a) a lower housing having a bottom surface, an upper working surface, two opposing side panels, a front panel, and a back panel, wherein said lower housing comprises:

a plurality of first compartments between said bottom surface and said upper working surface and means associated with said front panel and each of said two opposing side panels for accessing said plurality of first compartments;

b) a continuous perimeter lip raised above and surrounding said working surface for containing liquid spills;

c) an upper housing having two opposing side panels, a back panel, a top panel, and a front facing area holding at least one access door positioned above said lower housing, wherein said upper housing contains a plurality of second compartments accessed by said access door, wherein said plurality of second compartments comprise:

means for storing paint spray containers;

means for storing paint spray guns or handles; and means for storing different sized bottles;

d) a hood, fan, and ducting combination associated with said upper housing for exhausting vapors when said access door is either closed or open; and e) means associated with said lower housing for permitting movement by the user of the storage enclosure over a supporting surface.

5. A portable storage enclosure according to claim 4, wherein said hood, fan, and ducting combination is retractable into said upper housing.

6. A portable storage enclosure according to claim 4, wherein said means for storing different sized bottles comprises a tray having a series of first and second sized depressions.

* * * * *